US007347030B2

(12) United States Patent
Lewison

(10) Patent No.: US 7,347,030 B2
(45) Date of Patent: Mar. 25, 2008

(54) MODULAR TRUSS SYSTEM WITH A NESTING STORAGE CONFIGURATION

(76) Inventor: Steve Lewison, 14269 Aspen Ave., Prior Lake, MN (US) 55372

( * ) Notice: Subject to any disclaimer, the term of this patent is extended or adjusted under 35 U.S.C. 154(b) by 361 days.

(21) Appl. No.: 10/759,702

(22) Filed: Jan. 17, 2004

(65) Prior Publication Data

US 2004/0144055 A1 Jul. 29, 2004

Related U.S. Application Data

(60) Provisional application No. 60/441,401, filed on Jan. 21, 2003.

(51) Int. Cl.
*E04C 3/02* (2006.01)

(52) U.S. Cl. ..... 52/693; 52/650.1; 52/653.1; 52/648.1

(58) Field of Classification Search ..... 52/726.1, 52/726.2, 726.3, 584.1, 127.7, 693, 655.1, 52/653.2, 653.1, 650.1, 648.1, 81.3, 636, 52/638, 652.1, 692; 403/374.1, 373
See application file for complete search history.

(56) References Cited

U.S. PATENT DOCUMENTS 3,670,471 A * 6/1972 Smith ..... 52/638
4,484,430 A * 11/1984 Rossman ..... 52/726.1
4,549,381 A * 10/1985 Holtz ..... 52/337
4,907,390 A * 3/1990 Tene ..... 52/694
5,205,101 A * 4/1993 Swan et al. ..... 52/650.1
5,356,234 A * 10/1994 Vangool ..... 403/170
5,623,786 A * 4/1997 DeMeyer ..... 52/6
5,822,945 A 10/1998 Muller
5,964,068 A * 10/1999 O'Neill ..... 52/223.9
6,026,626 A * 2/2000 Fisher ..... 52/633
6,065,267 A * 5/2000 Fisher ..... 52/692
6,079,178 A 6/2000 Fisher
6,082,068 A 7/2000 Fisher
6,149,021 A 11/2000 Beaulieu
6,672,792 B1 * 1/2004 Schipani et al. ..... 403/322.4

* cited by examiner

*Primary Examiner*—Richard Chilcot
*Assistant Examiner*—William Gilbert

(57) ABSTRACT

An aspect of the present disclosure relates to a truss span. One embodiment includes at least three chords in a generally parallel orientation with respect to each other, where adjacent chords provide a face of the truss span. The truss span includes a web that connects two adjacent parallel chords that corresponds to at least two faces to provide the truss span with at least two webbed faces, and further includes first and second structural end brackets that connect two adjacent parallel chords to provide the truss span with at least one open face. An open face area is provided between the first and second structural end brackets. The truss span has a tapered profile such that another identical truss span is capable of nesting within the open face area between the first and second structural end brackets. Other aspects are provided herein.

31 Claims, 10 Drawing Sheets

MODULAR TRUSS SYSTEM WITH A NESTING STORAGE CONFIGURATION

CROSS REFERENCE TO RELATED APPLICATIONS

This application claims the benefit of U.S. Provisional Application Ser. No. 60/441,401, filed Jan. 21, 2003, under 35 U.S.C. §119(e) which is incorporated herein by reference in its entirety.

TECHNICAL FIELD

The present subject matter relates to truss systems, and in particular to modular truss systems for transportable structures.

BACKGROUND

It is known to provide a truss with a framework comprising interconnected chords where the truss is elongate with a square or triangular transverse cross section. These truss arrangements take up a great deal of room once disassembled and are thus expensive to store and transport.

One known system provides a truss in which the chords are foldable to take up less room for storage or transport. However, these trusses are weaker and more expensive to manufacture.

Another known system nests truss modules, and involves not installing webbing on one face. On the remaining faces, structural V-shaped formers are substituted for the webbing to prevent splaying of the chords in the open face. However, these formers are heavier than typical webbing members which serve as simpler axial two-force members.

Another known system nests truss modules, and includes removable cross-bracing on an open face, where the cross-bracing is removed for storage. However, this method adds parts, complexity, assembly time and cost to the design.

SUMMARY

Various embodiments of the present subject matter provide modular truss span components with fixed, rigid structure on all faces which allows for assembly into useful configurations. These components are also readily nest-able into compact stacks for storage and transportation without folding or removing elements.

One aspect generally relates to a truss span. One embodiment of the truss span includes at least three chords in a generally parallel orientation with respect to each other, where adjacent parallel chords provide a face of the truss span such that the at least three chords provide at least three faces. The truss span includes a web that connects two adjacent parallel chords that corresponds to at least two of the at least three faces to provide the truss span with at least two webbed faces. The truss span further includes a first structural end bracket and a second structural end bracket that connects two adjacent parallel chords corresponding to at least one of the at least three faces to provide the truss span with at least one open face. The first end bracket connecting a first end of the two adjacent parallel chords and the second end bracket connecting a second end of the two adjacent parallel chords provide an open face area between the first and second structural end brackets. The truss span has a tapered profile such that another identical truss span is capable of nesting within the open face area between the first and second structural end brackets.

One aspect generally relates to a system, comprising a plurality of truss spans. Each truss span includes at least three chords in a generally parallel orientation with respect to each other, where adjacent parallel chords form a face such that the at least three chords form at least three faces. Each truss span also includes a web connecting two adjacent parallel chords for at least two of the at least three faces. At least one of the three faces has two adjacent parallel chords connected by two structural end brackets. The plurality of truss spans has a tapered profile and a stacked configuration where a first truss span nests inside of a second truss span when the first truss span is inserted between the two structural end brackets of the second truss span.

One aspect relates to a joint system for joining truss spans having truss chords where at least a portion of the truss chords are hollow. According to an embodiment, the joint system includes a first access opening in a first hollow portion of the truss chord proximate to a first end of a first truss chord and a second access opening in a second hollow portion of the truss chord proximate to a second end of a second truss chord. The joint system further includes a first end plug with an aperture at the first end of the first truss chord and a second end plug with an aperture at the second end of the second truss chord. The joint system further includes a fastener extending through the aperture of the first end plug and into the aperture of the second end plug.

This Summary is an overview of some of the teachings of the present application and not intended to be an exclusive or exhaustive treatment of the present subject matter. Further details about the present subject matter are found in the detailed description and appended claims. Other aspects will be apparent to persons skilled in the art upon reading and understanding the following detailed description and viewing the drawings that form a part thereof, each of which are not to be taken in a limiting sense. The scope of the present invention is defined by the appended claims and their equivalents.

DETAILED DESCRIPTION

The following detailed description of the present subject matter refers to the accompanying drawings which show, by way of illustration, specific aspects and embodiments in which the present subject matter may be practiced. These embodiments are described in sufficient detail to enable those skilled in the art to practice the present subject matter. Other embodiments may be utilized and structural and logical changes may be made without departing from the scope of the present subject matter. References to "an", "one", or "various" embodiments in this disclosure are not necessarily to the same embodiment, and such references contemplate more than one embodiment. The following detailed description is, therefore, not to be taken in a limiting sense, and the scope is defined only by the appended claims, along with the full scope of legal equivalents to which such claims are entitled.

Figure 1:
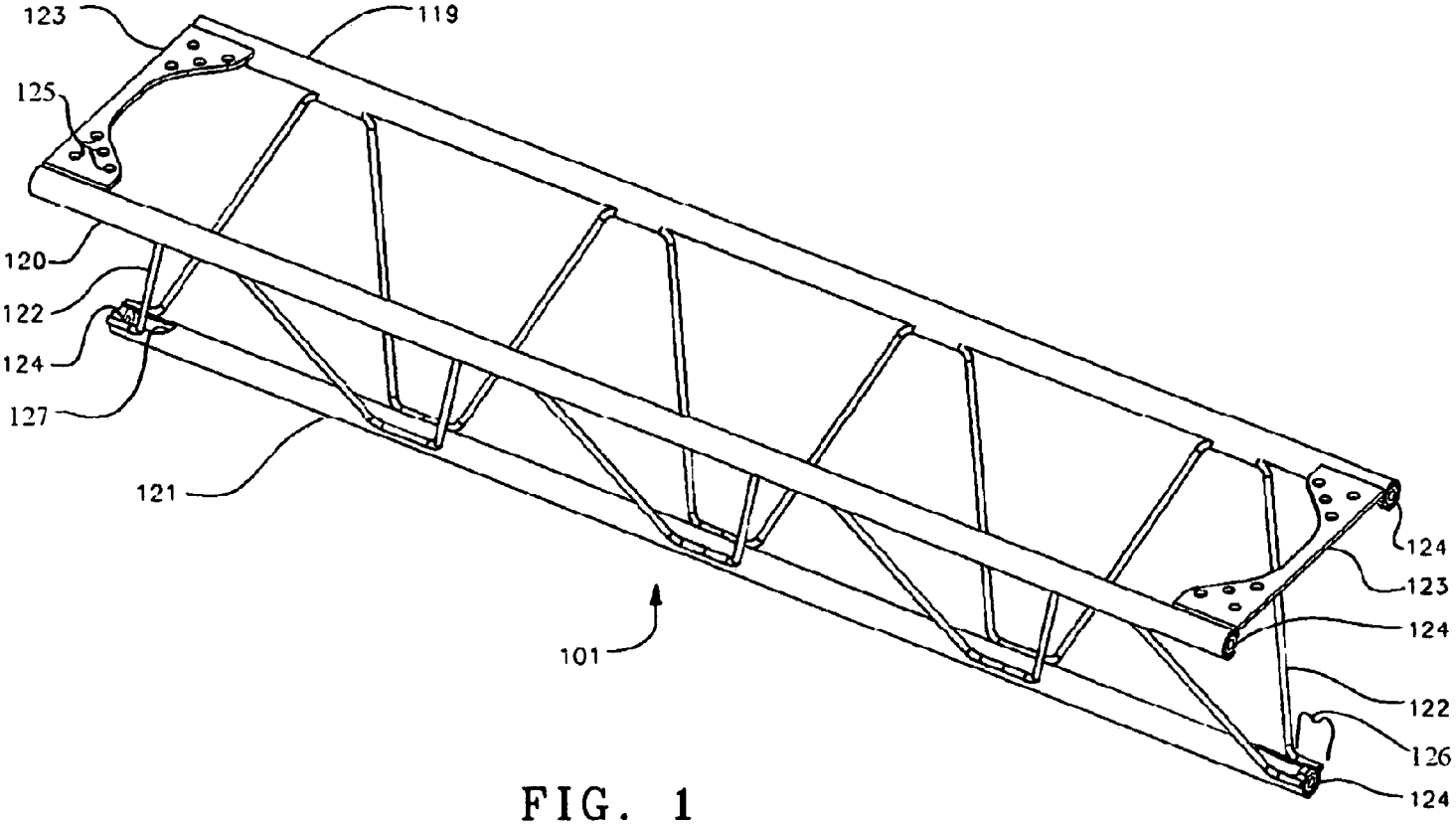
FIG. 1 is an isometric view of an embodiment of a triangular nesting truss span with integral structure on all faces.

FIG. 1 is an isometric view of an embodiment of a triangular nesting truss span with integral structure on all faces. The truss span 101 is an assembly consisting of tubular chords 119, 120 and 121 joined in a parallel fashion with end brackets 123 on one face and webbing 122 on the others. The end brackets 123 have a profile with a narrowed mid-section (see 899 in FIG. 8A) to create clearances for stacking similar truss spans 101 (see FIG. 2) and widened profiles (see 898 in FIG. 8A) at the points in which they are connected or welded to the chords for maximized structure. Various embodiments of end bracket have hole patterns 125 which provide for a simplified means of attaching other components and attachments, and can accommodate u-bolts sized to secure components of the same outside diameter as the chords 119, 120 and 121 as needed. In the illustrated embodiment, the web 122 is angled and triangulated to provide additional structural strength and leaves open regions (illustrated at 897 in FIG. 8A) with web offsets 126 from the ends of the chords. These web offsets 126 are opposite the end brackets. In various embodiments these web offsets 126 measure at least twice the width of the narrowed mid-sections (illustrate at 899 in FIG. 8A) of the end brackets 123 to allow for nesting of similar truss spans 101 in stacks of unlimited quantities. This embodiment shows end plug 124 joint features which have a through hole and are secured or welded to the ends of the tubular chords 119, 120 and 121 and provide for bolts or other joint methods to secure similar truss spans 101 or other compatible components in a serial manner. The ends of tubular chords 119, 120 and 121 have access holes 127 cut through the side walls of the tubes near the end plugs 124 to allow for the installation and securing of bolts and other fastening systems. (See FIGS. 5A-5C)

Figure 2:
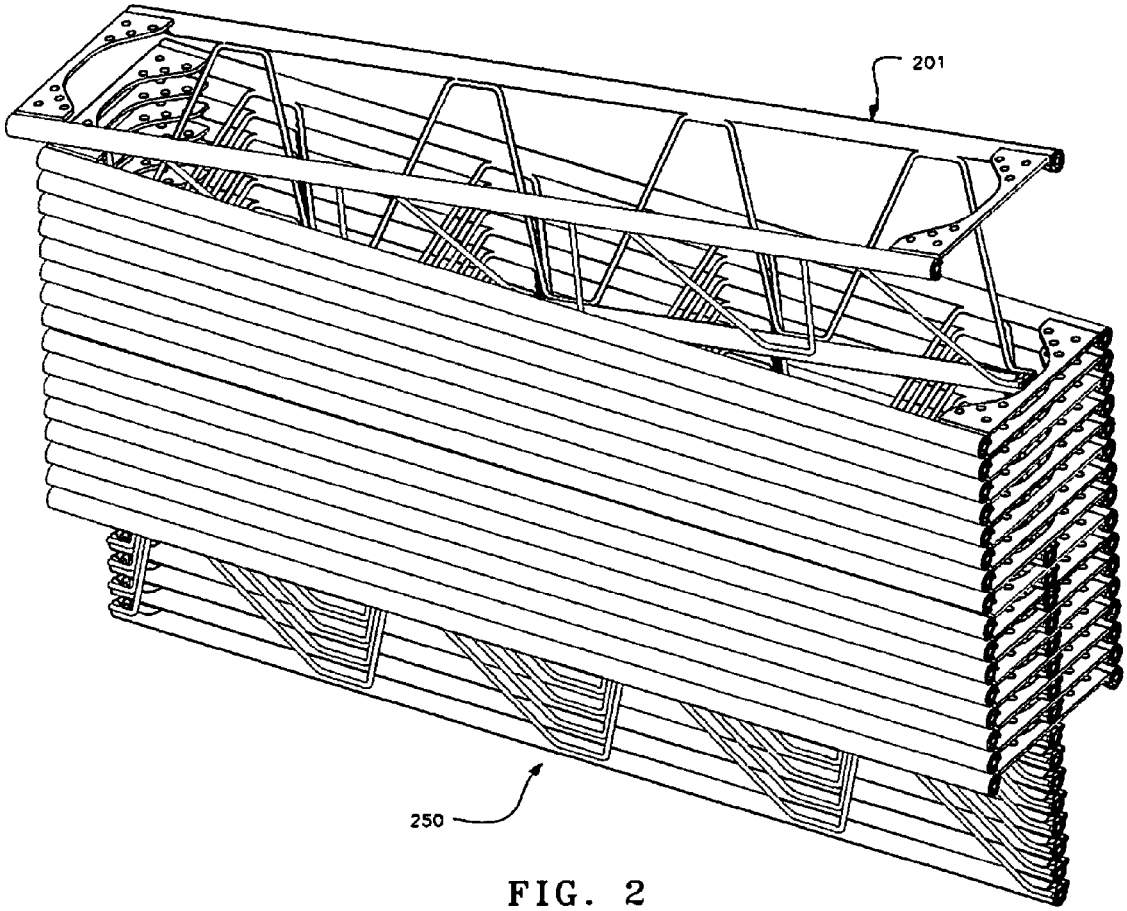
FIG. 2 shows a truss span of FIG. 1 nested for storage or transport with a stack of identical truss spans.
Figure 7A:
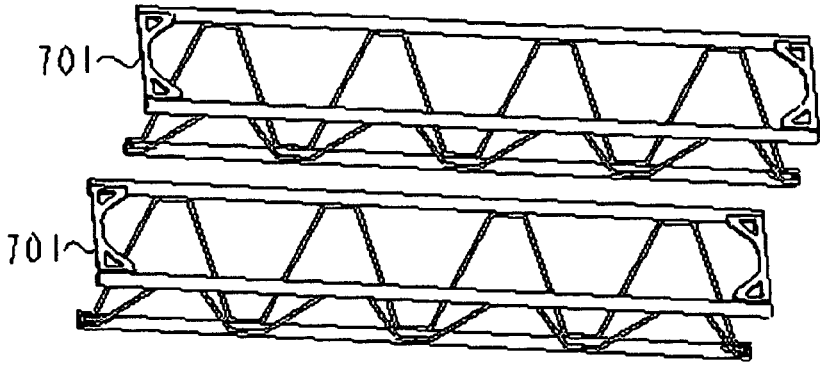
FIGS. 7A-7D show an isometric view of a pair of truss, previously illustrated in FIG. 1, and a process for nesting one truss within the other truss.
Figure 7B:
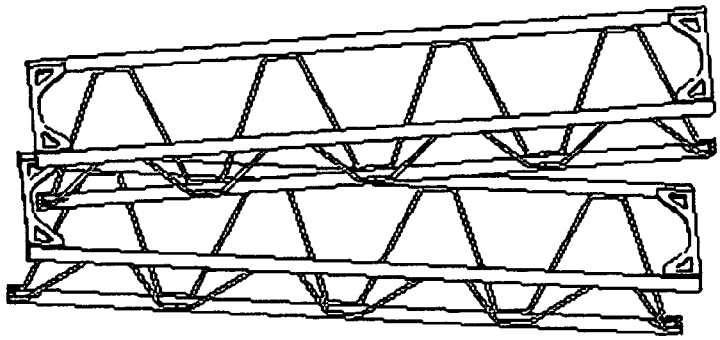
Figure 7C:
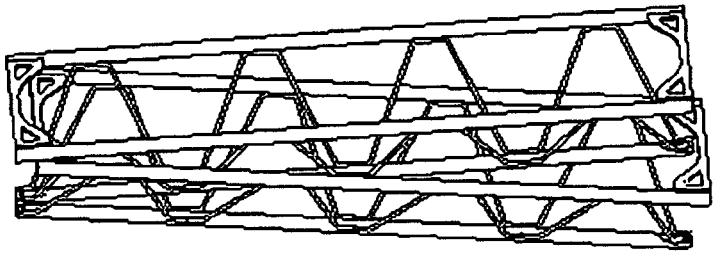
Figure 7D:
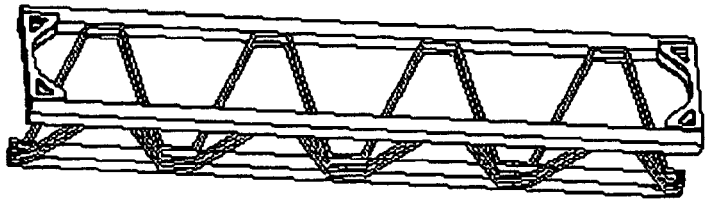

FIG. 2 shows the truss span of FIG. 1 nested for storage or transport with a stack of identical truss spans. This truss stack 250 can be created with the end brackets up (as shown), with the end brackets down (on the floor) or with the open features of the truss facing in another direction. The stack (as shown) is started by orienting one truss span with the end brackets up and by introducing a like truss span 201 in a similar orientation (see FIG. 7A). One end of the additional truss span 201 is then shifted slightly off-center (see FIG. 7B) to allow one bottom chord to drop just inside the other end bracket of the previously stacked truss spans. In the angled fashion shown in FIG. 2, the bottom chord can then be shifted off-center in the other direction (see FIG. 7C) under the end bracket(s) of the previously stacked truss spans. The end that is not yet nested can then be lowered into place and this added truss span 201 can be re-centered to form a uniform stack (see FIG. 7D). This process can be continued as needed for compact storage. The first truss span does not result in any space savings but every additional added truss sections nests within the stack and adds only a little more height than the chord diameter of the truss system. FIG. 2 show a truss span being added to a stack of sixteen truss spans and illustrates how this truss system can stack infinitely when a small amount of space is maintained, often with spacers, to allow the end brackets 123 (FIG. 1) to sit between the ends of the bottom chord 121 (FIG. 1).

In an embodiment with three parallel 1 inch OD tubular chords on 10 inch centers and 48 inches long, nesting the first two truss spans together results in a 35% cross-sectional space savings and the space savings percentage increases as units are added. Eight units or more results in a 65% cross-sectional space savings or better. A space savings exceeding 70% can be achieve in large stacks of 20 or more units and provides for very efficient commercial storage and shipping. The resulting stacks of truss spans, once aligned, create long internal voids between the webs which provide additional space to store other system components, hardware, graphics, or accessories.

Figure 3A:
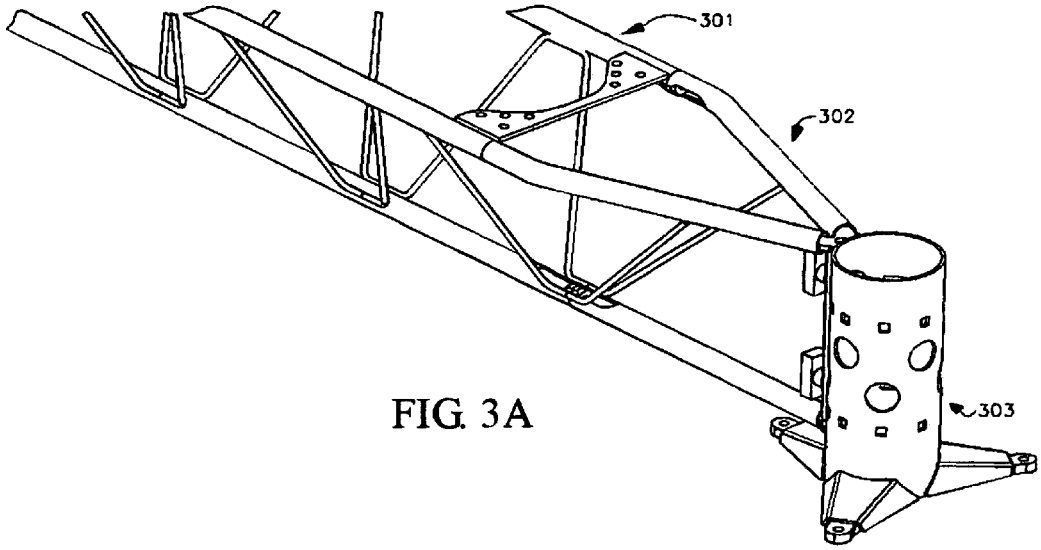
FIG. 3A show an assembled view of an embodiment of a hub system.
Figure 3B:
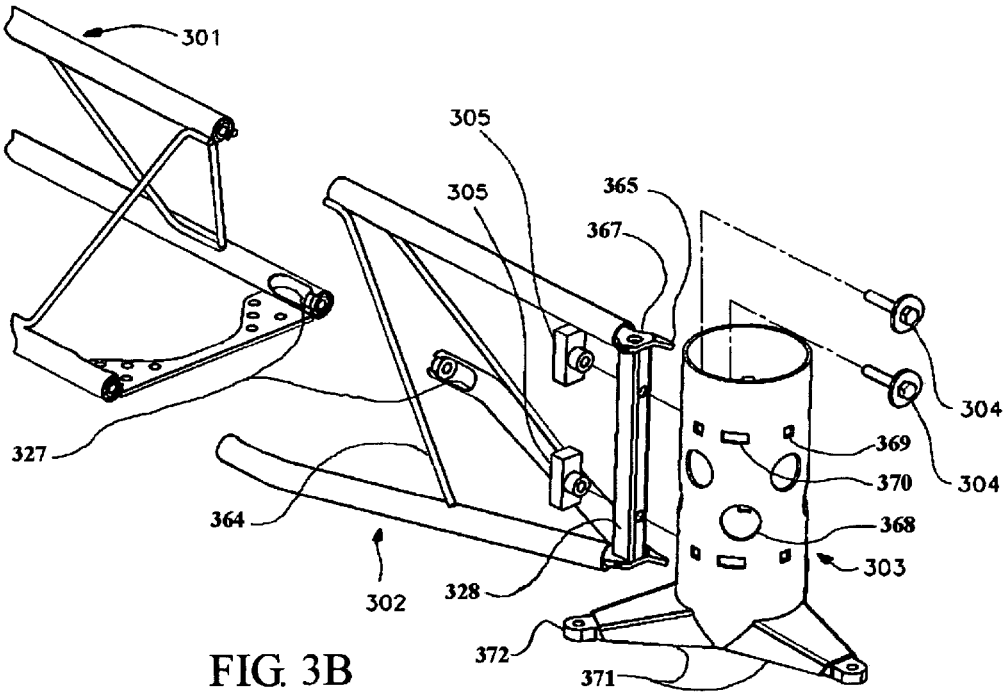
FIG. 3B show an exploded view of an embodiment of a hub system.

FIGS. 3A and 3B show an assembled and an exploded view, respectively, of an embodiment of a hub system. FIG. 3A shows an embodiment of an assembled hub system and related truss members, hubs, branches and fasteners and FIG. 3B shows an exploded view of FIG. 3A and also illustrates that branches can be assembled in a flipped orientation with the single tube of the branch at either the top or the bottom.

Figure 4:
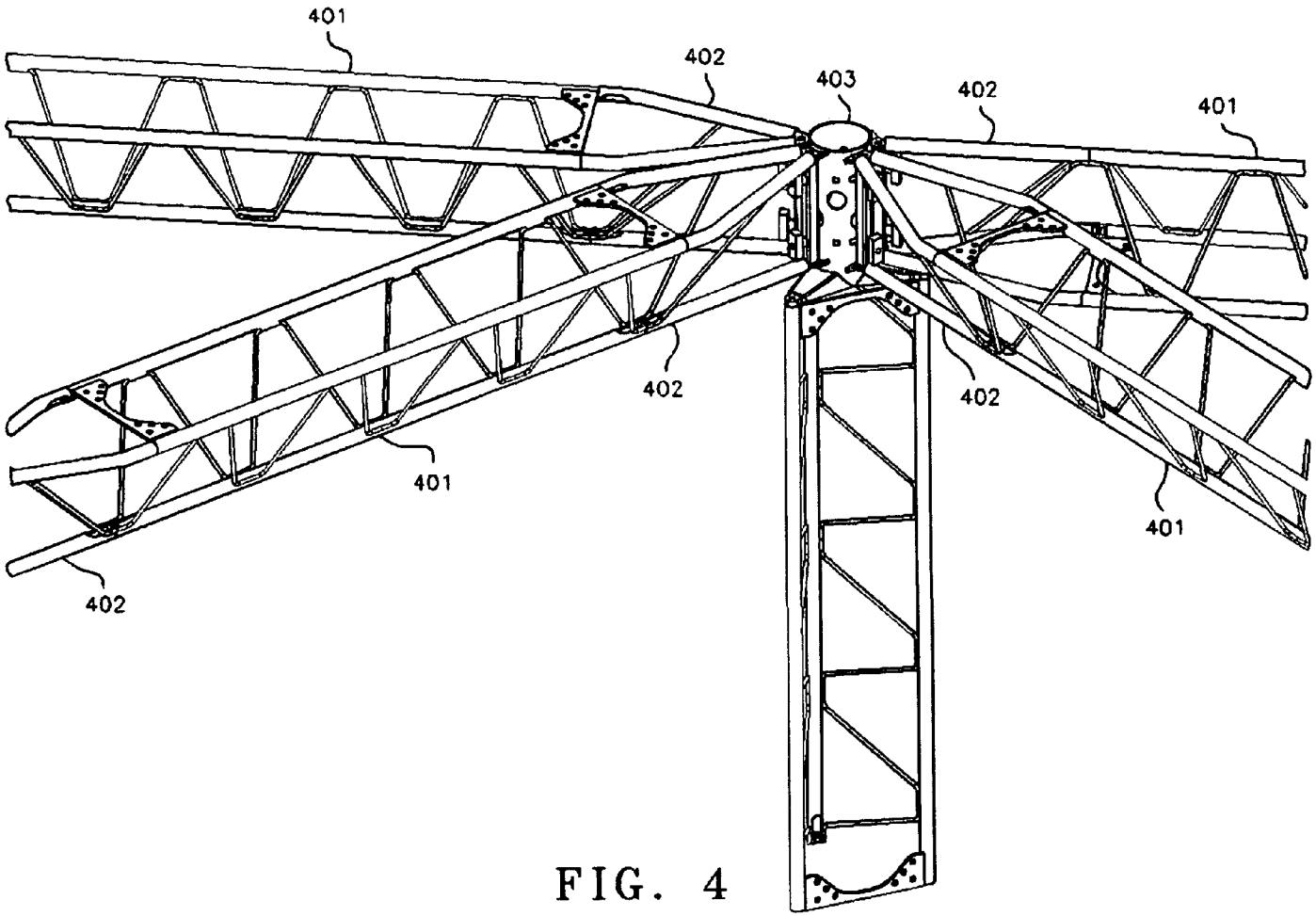
FIG. 4 shows some assembly configuration options for the hub system of FIG. 3A.
Figure 5A:
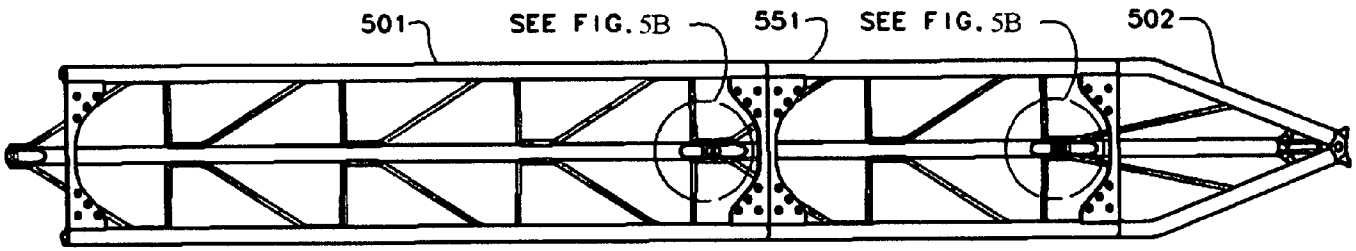
FIG. 5A shows an embodiment of a joint system.
Figure 5B:
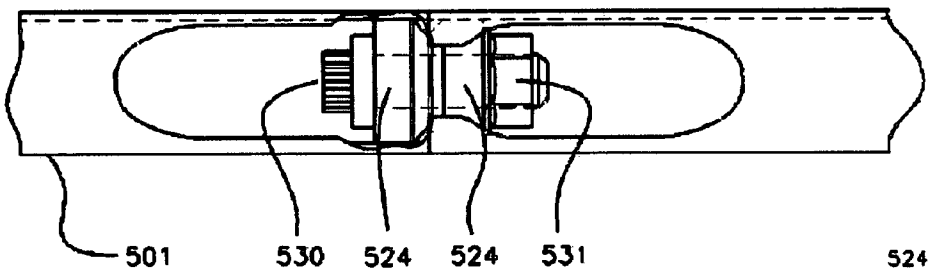
FIG. 5B shows an assembled view of the joint system of FIG. 5A.
Figure 5C:
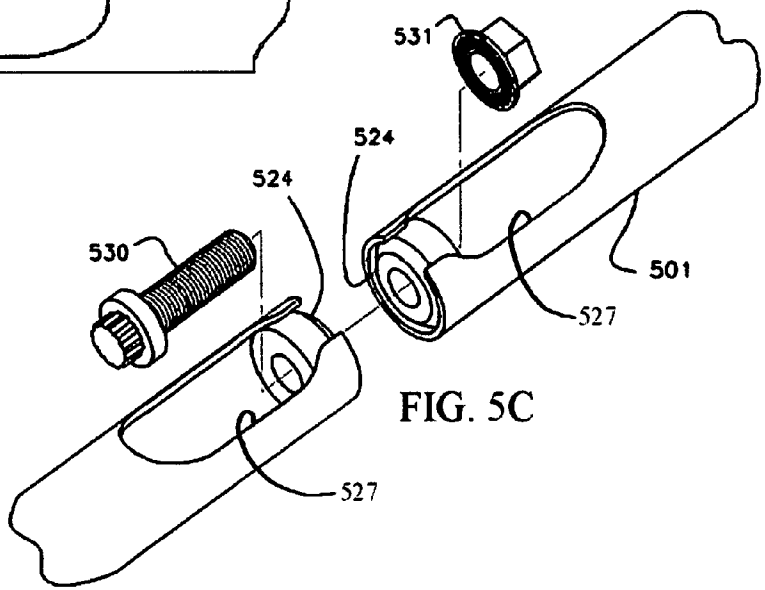
FIG. 5C shows an exploded view of the joint system of FIG. 5A.

FIGS. 3A and 3B illustrate how truss spans 301 (also illustrated as 101 in FIG. 1) connect to modular branches 302 and connect to modular hubs 303. The branches 302 have joint systems that can connect with truss spans 301 and in this embodiment the branches 302 have similar end plugs (illustrated as 524 in FIG. 5B) The end plugs are joint features which have a through hole and are secured or welded to the ends of the tubular chords 119, 120 and 121 and allow bolts or other joint methods to secure truss spans 101 or other compatible components in a serial manner. The tubular ends of the branches 302 have an access hole 327 cut through the side walls of the tubes near the end plugs to allow for the installation and securing of bolts and other fastening systems such as illustrated in FIGS. 5A-5C. The branches have cradles 367 which connect to modular hubs 303. In this embodiment, the branches are secured with hub bolts 304 and knobs 305. In this embodiment, these bolts fit through an arrangement of holes 369 and slots 370 which provide for branches 302 to be attached in multiple configurations. In this embodiment, the holes 369 are square to provide a self locking feature for the bolts 304 which have heads with enlarged mounting faces to distribute load stress and allow for thinner and lighter walls on the central cylinder of the hub 303. In this embodiment the large mount faces of the bolts 304 are efficiently produced from the slugs cut from the access holes 368 of the central tubular cylinders of the hubs 303. In this embodiment, these bolts 304 attach through rectangular tubes 328 of the branches 302 and can be secured with knobs 305 or nuts. These rectangular tubes 328 are capped at its ends with custom sheet metal cradles 367 which match the OD of the central cylinders of the hubs 303. The tabs 365 on these cradles 367 are angled, one up and one down, to allow them to clear each other when branches 302 are attached to the hubs 303 at close angles like 40 degrees as illustrated in FIG. 4. In this embodiment the branch cradles 367 also have tabs which fit the inside the tube elements of the branches and provide means to align and secure the tubes with processes like welding. The wire web 364 secured on the branches 302 provide structure and an aesthetic continuation of the webs on the truss spans 301 as shown in FIG. 3A.

In the illustrated embodiment, the hubs 303 have a central tubular cylinder with two patterns of holes 369 and slots 370 around its diameter which provide for a wide variety of assembly configurations. Additional larger holes are included to provide finger access for assembly and to reduce the weight of the hub. The three connection tabs 372 have through holes for connection to the ends of truss spans 301, which can commonly form vertical pillars (See FIG. 4). In this embodiment these tabs are connected to the central cylinder by means of tapered brackets 371.

FIG. 4 shows some assembly configuration options for the hub system of FIG. 3. The truss spans 401 can serve as horizontal and vertical structure. In this embodiment, up to eight branches 402 can be attached to a hub 403. This figure shows four branches 402 attached to a hub 403 and illustrates that the hole and slot patterns of the hub 403 allows for a variety of angles. The tapered nature of the branches 402 allow the truss spans to connect at narrow angles. In this embodiment the branches can mount at angles as narrow as 40 degrees. One of ordinary skill in the art will understand, upon reading and comprehending this disclosure, that the system can be designed to provide other angles or increments of angles. This figure also shows that branches 402 and truss spans 401 can be mounted with the single tube of the branch at either the top or the bottom as illustrated by the components on the right side of FIG. 4. With this angular and mounting versatility a wide variety of structural configuration can be achieved.

FIG. 5A shows an embodiment of ajoint system. FIG. 5A shows a standard truss span, a half length truss span (24 inches long in this embodiment) and a branch component. Two of the joint locations are circled and reference FIG. 5B which shows the nature of the tubular joint system of this embodiment. This joint system is used to join the chords of standard length truss spans 501, fractional length truss spans 551, branches 502 or compatible components like the three connection brackets 371 of the hubs, FIG. 5B shows an assembled view of the joint system of FIG. 5A. FIG. 5B shows the end plugs 524 secured, such as welded, in the ends of the tubular chords and the access holes 527 in the wall of the tube. FIG. 5B also shows how a bolt 530 and nut 531 secures a chord section.

FIG. 5C shows an exploded view of the joint system of FIG. 5A. FIG. 5C shows how the access holes 527 in the tube wall allows for the installation and wrenching of bolts 530, nuts 531 or other securing hardware through the end plugs 524. An embodiment of the joint system has a bolt 530 wherein the drive head has a diameter smaller than a diameter of a flange of the bolt. An example of such a bolt is a bolt with a twelve-point-drive head. An embodiment of the nut is a serrated or other self-locking flange nuts 531. This off-the-shelf hardware simplifies and speeds up the assembly process. The twelve-point bolt 530, with the smaller drive size allows smaller, common wrenches to tighten the bolts in the limited space inside the chords and access holes 527. The serrated flange nut 531 secures itself once it is finger tightened and does not require the use of a second wrench. When tightened, the clamping nature of the bolts removes gaps and pre-loads the joints to minimize slop between the truss system components, even when loaded. The smaller head on the twelve point drive bolts 530 results in simplified assembly since only common twelve-point wrenches are required. This arrangement also allows assembly speed to increases when ratchet style twelve-point box wrenches are used. This nesting truss system illustrated in FIG. 2 allows for various truss span features and joint designs.

Figure 6:
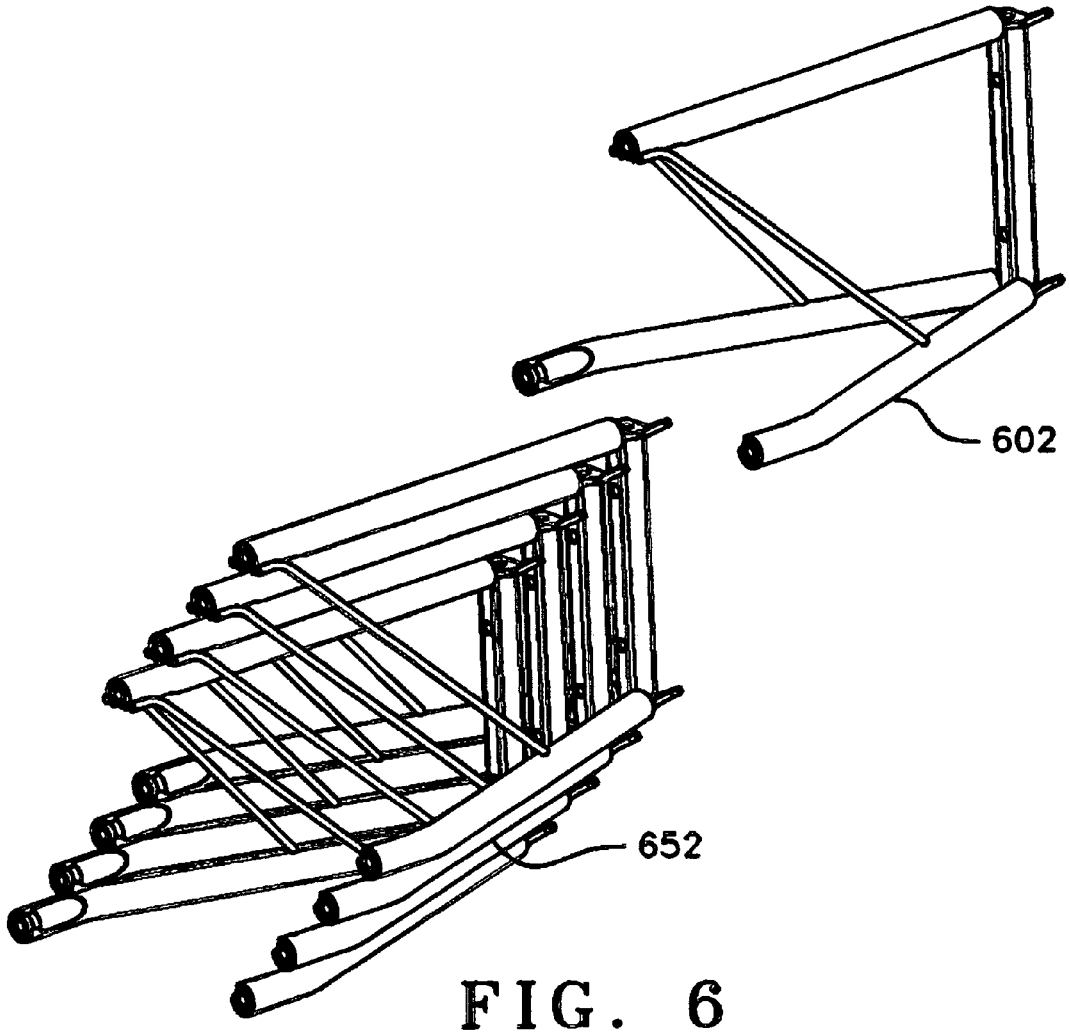
FIG. 6 shows a stack of branches, illustrated in FIGS. 3A and 3B, nested for storage or transport.

FIG. 6 shows a stack of branches, illustrated in FIGS. 3A and 3B, nested for storage or transport. The open nature of the branches 602 allows for easy nesting into branch stacks 652. In this embodiment, a stack of two branches saves about 35% of the required storage volume. A stack of four branches 652, as shown, saves about 50% of the required storage volume. A stack of eight branches saves about 58% of the required storage volume.

FIGS. 7A-7D show an isometric view of a pair of truss, previously illustrated in FIG. 1, and a process for nesting one truss within the other truss. These figures sequentially illustrates how truss spans 701 are stacked in pairs or larger stacks (illustrated at 250 in FIG. 2) by first inserting one end of a truss span to be added to a stack (illustrated in FIG. 7B), then shifting the truss span past center (FIG. 7C) to created clearance for the second end, and then inserting and re-centering the added truss span (illustrated in FIG. 7D).

Figure 8A:
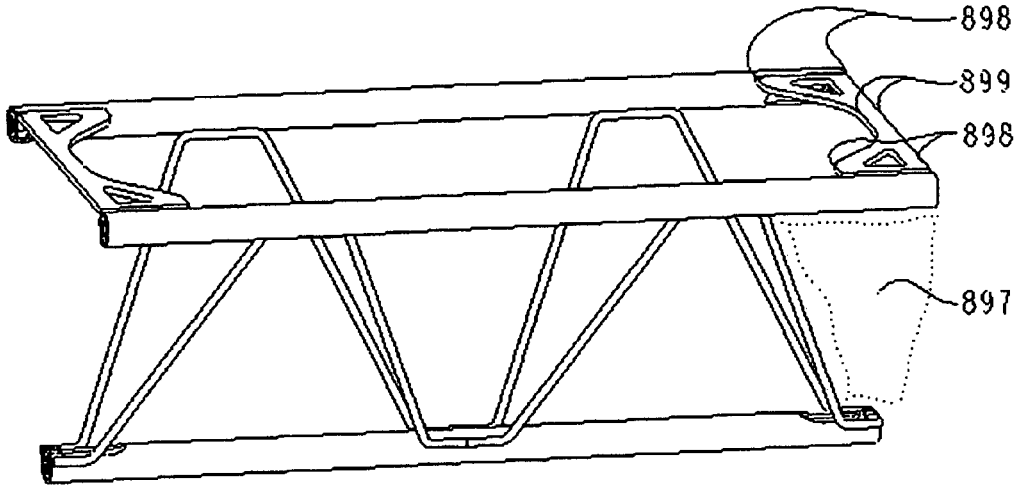
FIGS. 8A and 8B show end bracket embodiments with thinner mid-sections and corresponding functional webbing clearances.
Figure 8B:
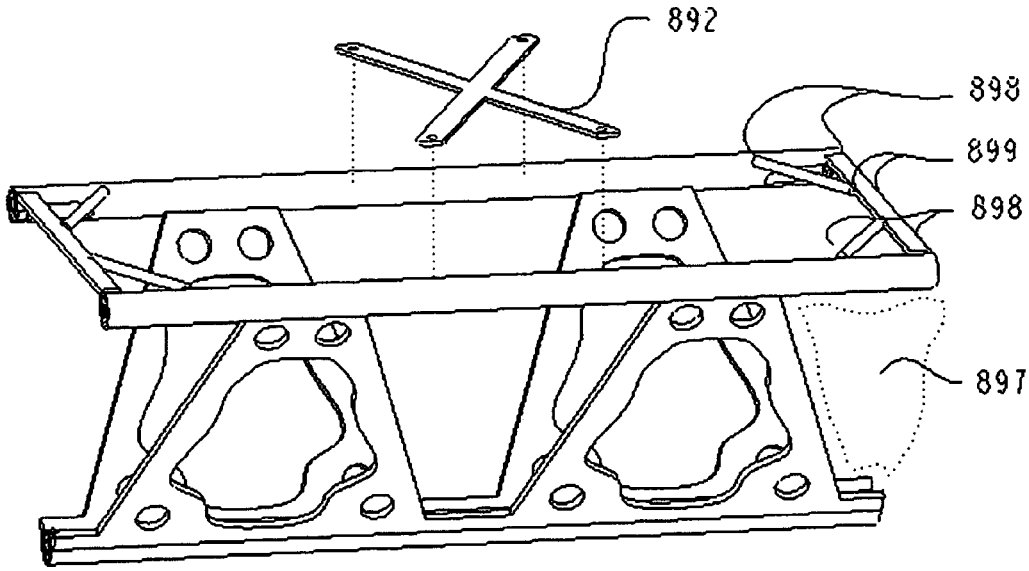

FIGS. 8A and 8B shows various embodiments of end brackets (illustrated at 123 in FIG. 1) and webs (illustrated at 122 in FIG. 1) with profiles and clearance areas which allow truss spans to nest in a compact manner (illustrated in FIGS. 7A-7D). As illustrated in both FIG. A and B, the narrow sections 899 of the end brackets create clearance for central chords 121 as truss spans are nested. The wide sections 898 of the end brackets allows for increased strength. The resulting triangulated outer sections of the end brackets effectively stiffens the member and provide additional connection area for securing the bracket to the chord with weld, adhesive and the like. The end brackets effectively prevent outward movement of the attached chords 119 and 120. The triangulated outer sections of the end brackets additionally resist racking movements of the open face. This arrangement means that the chords 119 and 120 are less prone to move parallel to each other. The structure of the end brackets 123, combined with the webs, adds stiffness to truss spans under several different load conditions including torsion around the central axis of the truss span 101. FIGS. 8A and 8B illustrates various embodiments of end brackets 123 which resist splaying and racking of the attached chords. FIG. 8A shows an end bracket embodiment made of profiled plate or sheet material and FIG. 8B shows an end bracket embodiment of an assembly of elongated members. FIG. 8A shows a web embodiment made of at least one elongated member such as a continuous wire or separate wire elements. FIG. 8B shows a web embodiment made of profiled plate or sheet material. Nesting truss spans 101 have web embodiments with open regions 897 which allow the web faces to clear the end brackets 123 as truss spans are nested as shown in FIGS. 7A-7D. Truss spans 101 have web embodiments with open regions 897 which are sized to allow nesting clearance on truss span with various end bracket embodiments.

Various embodiments of the truss spans 101 include removable braces 892 attached across the open face formed between the two end brackets 123 and the chords 119 and 120 of a truss span 101 and can be detached or folded before creating nested stacks.

Figure 9:
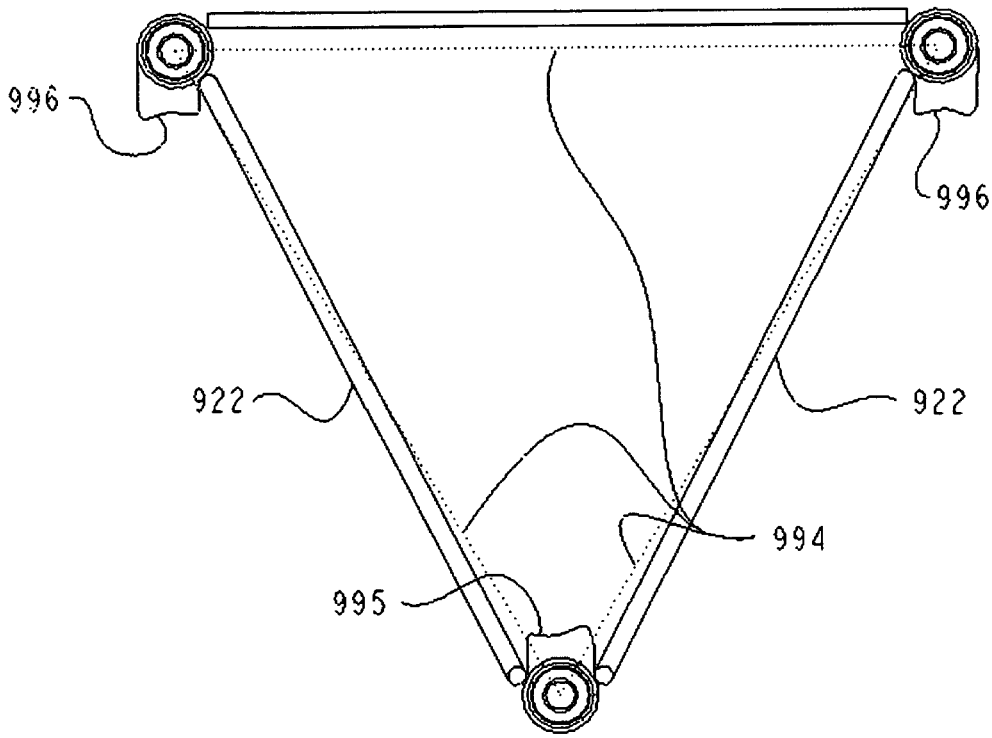
FIG. 9 is an end view of a truss and illustrates how web connections are offset to create additional clearance when nested in stacks.

FIG. 9 shows that in some embodiments the connection points of the webs 922 to the chords are offset in a manner to minimize truss stack height and volume (illustrated as 250 in FIG. 2). In some embodiments, the webs 922 are secured in orientations that are angled relative to the planes created by the adjacent chords or the center-to-center lines 994 connecting the center of the chords. Stack size is minimized when the attachment points of the webs 922 to the center chord 121 are shifted outward increasing region 995 and the attachment points for the other chords 119 and 120 are shifted inward increasing region 996. This assembly of web members at irregular angles prevents interference of the webs 922 with the chords of adjacent truss spans as they form stacks (illustrated as 250 in FIG. 2).

Figure 10:
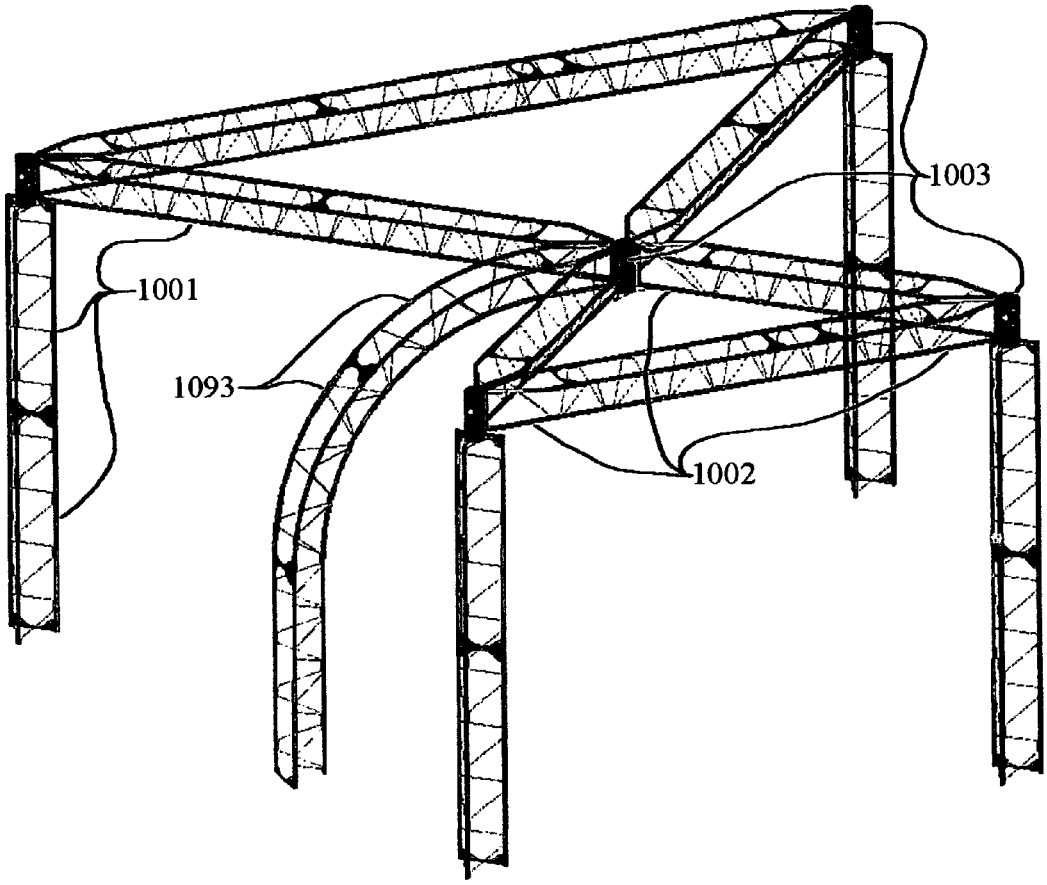
FIG. 10 illustrates an example of an assembled truss system which includes curved and straight truss elements according to various aspects of the present subject matter.

FIG. 10 shows one embodiment of an assembly configuration of the truss system. The central hub 1003 is shows an arrangement without any vertical truss attached to form columns. The other hubs 1003 illustrate arrangements with truss columns created with truss spans 1001. Branches 1002 are shown connected to truss spans 1001 and assembled to hubs at a variety of narrow and wide angles. The hubs 1003 are shown assembled with different numbers of branches. FIG. 10 shows a curved truss embodiment 1093 of truss spans 1001. The end brackets of the curved truss are fixed to the face on the outer radius and maintain the ability to create compact stacks like those created by straight embodiments of the truss spans (illustrated as 250 in FIG. 2). FIG. 10 illustrates the versatility of this modular truss system.

The truss can be used where compact storage, transportability, or easy-to-configure structures are needed in applications like, but not limited to, trade-show displays, commercial displays, concert and performance venues, dance floor lighting, outdoor tents, shelter systems and other support systems.

In one embodiment, the truss system has a triangular cross-section. Other nesting shapes are possible, and are within the scope of this disclosure. Truss spans with a tapered transverse cross-section like triangular and trapezoidal allow nesting. The truss system features one face in which the common truss webbings are replaced with end brackets which leave one face open and allows the components to nest together in a compact manner (like paper cups) for storage and shipping.

The end bracket supports achieve structure and an ability to nest with thin member in the middle section and a triangular shape connecting to the adjacent truss chords.

This one piece truss arrangement, along with other specific truss webbing features, allows compact storage and shipping, and also achieves a simplified, one piece assembly which is more economical to produce than other multi-piece, folding truss systems.

In one embodiment, the joint system in the truss assembly (IE. built on 1 inch OD tubing) relies on common (in this application ⅜ inch) fasteners bolted through holes in end plugs welded to the truss tubing and accessed through access cut outs near the ends of the truss tubing.

This readily transportable truss having various embodiments with one face which is framed in with structural end brackets allows the truss to nest with other similar trusses in a storage configuration and provides for fixed structure on all faces with web members or end brackets.

Two of the three or more chords are rigidly connected by two end brackets; with a necked down area and specifically designed to form a structural face with unobstructed midsection which, with solid, hollow, or internally reinforced chords, can resist splaying and racking forces. Additional chords are rigidly connected parallel to the two chords, to form a triangular or other tapered transverse cross-section and are connected by web members (wires or other plate members) in a rigid manner and that can resist splaying or racking forces on the attached chords.

This truss arrangement, with structural end brackets on one face, provides open regions at the ends of other webbed faces to provide for the ability of the components to nest. The web members (wire or other plate type elements) connected to the third chord leave an unobstructed region at the end of the chords opposite the end bracket. Web members and the unobstructed regions have various embodiments. When web members have a gap from the end of the third chord of a distance of at least twice the thickness of the narrowed midsection of the end brackets of the truss and have angled profiles as to not interfere with the end brackets of trusses as the trusses are nested, stacks of unrestricted quantities can be made without interfering with the end bracket as the stacks are increased. In various embodiments, webs with sufficiently angled profiles but without a sufficient gap from the end of the third chord can be nested into stacks of limited quantities. Truss stack are made by first inserting one end, shifting it past center, dropping the other end in and re-centering the truss. This arrangement applies to truss embodiment in which the chords are straight or curved.

This truss arrangement, with additional similar truss, allow for a modular truss structure, where the trusses are joined end to end in serial alignment by means of various jointing system embodiments.

This truss design provides for a stacked truss arrangement comprising at least two trusses, being stacked on top of and inter-nested with one another.

A reconfigurable modular truss hub arrangement with a cylindrical hub or core can connect to truss elements in an axial (typically vertical) manner, on the top and bottom, with fixed or attachable connectors to form pillars. The hub arrangement incorporates means of attaching radial (horizontal) branch truss connectors which can be added as needed to form a variety of truss structure configurations and utilizes specifically designed pairs of both holes and slots which provide a versatile degree of security, alignment, and angular options.

The branch system complements the truss hubs system and provides one end for attachment to truss members and the other end designed for connection to cylindrical hub component with structure which tapers to a tall, narrow profile which allows for adjacent branch truss connectors to mount at various angles, even uniquely narrow angles like 40 degrees, to each other and allowing for beneficial versatility, while still resulting in sufficient resistance to many common forces and moments developed by applied torques and cantilever type loads due to its two points of fastening the branches to top and bottom locations on the hub and the inclusion of concave cradles on the upper and lower parts of the branches which match the cylindrical core of the hubs and produce a widened base which resists lateral forces and movement of the branches and attached truss components in the radial plane, and incorporates additional and beneficial width of this cradle by angling the ends of the cradles on one side of the branch at a slight angle up and the other down thereby allowing the cradles of adjacent branches mounted at small angles to not interfere with each other and all the while the tapered branches have open aspects which allow them to nest in compact branch stacks for storage and transport.

A joint system for securing the chords of the truss system components which incorporate tensile fasteners (threaded, quarter-turn, C-clamp style, or otherwise) inserted through windows produced in the side of the hollow chords and through holes in end plugs welded in the ends of the hollow chord such that the chords and attached assemblies are secured with a multitude of fastening embodiments which includes securing with commercially available 12 point drive bolts and tightened with common fixed or ratcheting box wrenches or securing with standard hex head fasteners which are tightened with custom wrenches low profile wrenches which in turn fasten to various nut embodiment which includes "serrated flange nuts" which resist rotation as the mating bolts are tightened allowing this joint system to not require a second wrench. The simple through hole design is genderless and does not require any special matching of component ends. The threaded nature of the joining system is pre-loaded-able, secure, and economical with the use of off-the-shelf hardware. This joint system also accommodates external c-clamp type hardware designed for fast assembly.

Although specific embodiments have been illustrated and described herein, it will be appreciated by those of ordinary skill in the art that any arrangement which is calculated to achieve the same purpose may be substituted for the specific embodiment shown. This application is intended to cover adaptations or variations of the present subject matter. It is to be understood that the above description is intended to be illustrative, and not restrictive. Combinations of the above embodiments as well as combinations of portions of the above embodiments in other embodiments will be apparent to those of skill in the art upon reviewing the above description. The scope of the present subject matter should be determined with reference to the appended claims, along with the full scope of equivalents to which such claims are entitled.

I claim:

1. A truss span, comprising:

at least three chords in a generally parallel orientation with respect to each other, wherein adjacent parallel chords provide a face of the truss span such that the at least three chords provide at least three faces;

a web connecting two adjacent parallel chords corresponding to at least two of the at least three faces to provide the truss span with at least two webbed faces; and a first structural end bracket and a second structural end bracket connecting two adjacent parallel chords corresponding to at least one of the at least three faces without contacting any other of the at least three chords to provide the truss span with at least one open face, the first end bracket connecting a first end of the two adjacent parallel chords and the second end bracket connecting a second end of the two adjacent parallel chords to provide an open face area between the first and second structural end brackets;

wherein the truss span has a tapered profile such that another identical truss span is capable of nesting within the open face area between the first and second structural end brackets;

wherein the first structural end bracket has two end portions and a middle portion between the two end portions, and further has an inside edge and outside edge, the outside edge being approximately flush with the first end of the two adjacent parallel chords corresponding to the open face of the truss span, and the inside edge having a shape such that the middle portion has a width that is smaller than a width of the two end portions; and wherein the second structural end bracket has two end portions and a middle portion between the two end portions, and further has an inside edge and outside edge, the outside edge being approximately flush with the second end of the two adjacent parallel chords corresponding to the open face of the truss span, and the inside edge having a shape such that the middle portion has a width that is smaller than a width of the two end portions.

2. The truss span of claim 1, wherein the web formed between two adjacent parallel chords includes at least one elongated member providing multiple connection points between the two adjacent parallel chords.

3. The truss span of claim 1, wherein the web includes a plurality of web plates, each web plate connecting the two adjacent parallel chords.

4. The truss span of claim 1, wherein the at least two webbed faces include an unobstructed region at each end of the truss span, the unobstructed region extending a distance from the end of the truss span that is at least twice the width of the middle portion of the first and second end brackets.

5. A system, comprising:

a plurality of truss spans, each truss span including:

at least three chords in a generally parallel orientation with respect to each other, wherein adjacent parallel chords form a face such that the at least three chords form at least three faces;

a web connecting two adjacent parallel chords for at least two of the at least three faces; and at least one of the three faces having two adjacent parallel chords connected by two structural end brackets without the two structural end brackets contacting any other of the at least three chords; and the plurality of truss spans having a tapered profile and a stacked configuration where a first truss span nests inside of a second truss span when the first truss span is inserted between the two structural end brackets of the second truss span, wherein each of the structural end brackets has two end areas of at least a first width attached to the two adjacent parallel chords and further has a middle area of a thinner width.

6. The system of claim 5, wherein the plurality of truss spans have an assembled configuration where the first truss span is connected in-line to the second truss span.

7. The system of claim 5, further comprising removable bracing adapted to further support the two adjacent parallel chords connected by two structural end brackets.

8. The system of claim 5, wherein the web is separated from a first end and a second end of the chords by a distance equal or greater to twice the width of the middle area of the structural end brackets.

9. In a truss system having at least one truss span having at least three substantially parallel chords and an end, at least one generally cylindrically-shaped hub having a cylindrical outer wall having a top and a bottom wherein the hub includes at least one pair of pre-formed holes in the cylindrical outer wall, and at least one connection member having a first end and a second end wherein the connection member is attached to each chord at the first end and attached to the hub at the at least one pair of pre-formed holes at the second end, a method for forming a truss assembly, comprising: attaching the second end of the connection member to the hub at the at least one pair of pre-formed holes so that the connection member radially extends away from the hub; and attaching each chord member of the truss span to the first end of the connection member.

10. the method of claim 9, further comprising attaching one or more connection members to the hub in a plane.

11. the method of claim 9, further comprising attaching an end of a truss span to the hub through a connection member extending radially away from the hub near either the top or bottom of the hub.

12. A joint system for joining truss spans having truss chords where at least a portion of the truss chords are hollow, comprising:

a first access opening in a first hollow portion proximate to a first end of a first truss chord and a second access opening in a second hollow portion proximate to a second end of a second truss chord; and a first end plug with an aperture at the first end of the first truss chord and a second end plug with an aperture at the second end of the second truss chord; and a fastener extending through the aperture of the first end plug and into the aperture of the second end plug.

13. The joint system of claim 12, wherein:

the fastener includes a bolt and a nut;

the bolt is capable of being inserted into the first access opening and extend through the apertures of the first and second end plugs;

the nut is capable of being inserted into the second access opening; and the bolt and the nut are capable of being tightened by inserting a wrench through at least one of the first and second access openings.

14. The joint system of claim 13, wherein the bolt includes a drive head and a flange, wherein the drive head has a diameter smaller than a diameter of the flange.

15. A truss span, comprising:

at least three chords in a generally parallel orientation with respect to each other, wherein adjacent parallel chords provide a face of the truss span such that the at least three chords provide at least three faces;

a web connecting two adjacent parallel chords corresponding to at least two of the at least three faces to provide the truss span with at least two webbed faces; and a first structural end bracket and a second structural end bracket connecting two adjacent parallel chords corresponding to at least one of the at least three faces to provide the truss span with at least one open face, the first end bracket connecting a first end of the two adjacent parallel chords and the second end bracket connecting a second end of the two adjacent parallel chords to provide an open face area between the first and second structural end brackets;

wherein the truss span has a tapered profile such that another identical truss span is capable of nesting within the open face area between the first and second structural end brackets, wherein each of the at least three chords includes a cylindrical chord, each cylindrical chord has a cylindrical wall, a first end and a second end, each end of the cylindrical chord having an end plug with an aperture, each cylindrical chord further having a first access opening and a second access opening through the cylindrical wall, the first access opening being proximate to the first end of the cylindrical chord and the second access opening being proximate to the second end of the cylindrical chord, wherein the apertures and the access openings are sized to allow fasteners to be inserted into the access openings and through the apertures for connecting the chords from another truss span.

16. A system, comprising:

a plurality of truss spans, each truss span including:

at least three chords in a generally parallel orientation with respect to each other, wherein adjacent parallel chords form a face such that the at least three chords form at least three faces;

a web connecting two adjacent parallel chords for at least two of the at least three faces; and at least one of the three faces having two adjacent parallel chords connected by two structural end brackets; and the plurality of truss spans having a tapered profile and a stacked configuration where a first truss span nests inside of a second truss span when the first truss span is inserted between the two structural end brackets of the second truss span, wherein each of the chords includes a cylindrically-shaped tube, wherein the first truss span is adapted to be connected to the second truss span by joint systems for connecting chords from one truss span to chords from another truss span, wherein each tube has a cylindrical wall; and each joint system includes:

a first access opening in the cylindrical wall proximate to a first end of a first tube and a second access opening in the cylindrical wall proximate to a second end of a second tube;

a first end plug with an aperture located in the first end of the first tube and a second end plug with an aperture located in the second end of the second tube; and a fastener extending through the apertures of the first and second end plugs.

17. A system, comprising:

a hub;

a plurality of truss spans, each truss span including:

at least three chords in a generally parallel orientation with respect to each other, wherein adjacent parallel chords form a face such that the at least three chords form at least three faces;

a web connecting two adjacent parallel chords for at least two of the at least three faces; and at least one of the three faces having two adjacent parallel chords connected by two structural end brackets; and the plurality of truss spans having a tapered profile and a stacked configuration where a first truss span nests inside of a second truss span when the first truss span is inserted between the two structural end brackets of the second truss span, and a plurality of connection members, each connection member including a plurality of members, each connection member including a tapered end adapted to connect to the hub such that a number of connection members are able to be attached to a single hub to radially extend from the hub in a single plane, wherein the hub includes a cylindrical hub, each connection member including at least one cradle having a first tab and a second tab to contact the cylindrical hub, the first and second tabs extending away from the connection member to enhance stability of the connection member against the hub, the first tab being biased in a upward direction and the second tab being biased in a downward direction such that tabs from adjacent connection members do not interfere with each other at narrow angles.

18. A system, comprising:

a plurality of truss spans, each truss span including:

at least three chords in a generally parallel orientation with respect to each other, wherein adjacent parallel chords form a face such that the at least three chords form at least three faces;

a web connecting two adjacent parallel chords for at least two of the at least three faces without the two structural end brackets contacting any other of the at lease three chords; and at least one of the three faces having two adjacent parallel chords connected by two structural end brackets; and the plurality of truss spans having a tapered profile and a stacked configuration where a first truss span nests inside of a second truss span when the first truss span is inserted between the two structural end brackets of the second truss span, and at least one hub;

a plurality of connection members adapted to connect the truss spans to the hub;

wherein the hub includes a cylindrical wall, and a set of pre-formed holes for use to fasten connection members to the hub, wherein the set of pre-formed holes includes a set of holes equally distributed around a circumference of the hub to fasten four connection members, each connection member being separated from another connection member by approximately 90°, wherein the hub further includes a set of pre-formed slots for use to fasten connection members to the hub, the slots being positioned between the holes.

19. The system of claim 18, wherein the set of pre-formed holes and the set of pre-formed slots are positioned and sized to allow a connection member to be connected to the hub within a plane with another connection member and at an adjustable angle.

20. A truss span, comprising:

at least three chords in a generally parallel orientation with respect to each other, wherein adjacent parallel chords provide a face of the truss span such that the at least three chords provide at least three faces, wherein each of the at least three chords includes a cylindrical chord and wherein:

each cylindrical chord has a cylindrical wall, a first end and a second end, each end of the cylindrical chord having an end plug with an aperture;

a first access opening and a second access opening through the cylindrical wall, the first access opening being proximate to the first end of the cylindrical chord and the second access opening being proximate to the second end of the cylindrical chord, the apertures and the access openings are sized to allow fasteners to be inserted into the access openings and through the apertures for connecting the chords from another truss span;

a web connecting two adjacent parallel chords corresponding to at least two of the at least three faces to provide the truss span with at least two webbed faces; and a first structural end bracket and a second structural end bracket connecting two adjacent parallel chords corresponding to at least one of the at least three faces without contacting any other of the at least three chords to provide the truss span with at least one open face, the first end bracket connecting a first end of the two adjacent parallel chords and the second end bracket connecting a second end of the two adjacent parallel chords to provide an open face area between the first and second structural end brackets;

wherein the truss span has a tapered profile such that another identical truss span is capable of nesting within the open face area between the first and second structural end brackets.

21. A truss span, comprising:

at least three chords in a generally parallel orientation with respect to each other, wherein adjacent parallel chords provide a face of the truss span such that the at least three chords provide at least three faces;

a web connecting two adjacent parallel chords corresponding to at least two of the at least three faces to provide the truss span with at least two webbed faces; and a first structural end bracket and a second structural end bracket connecting two adjacent parallel chords corresponding to at least one of the at least three faces without contacting any other of the at least three chords to provide the truss span with at least one open face, the first end bracket connecting a first end of the two adjacent parallel chords and the second end bracket connecting a second end of the two adjacent parallel chords to provide an open face area between the first and second structural end brackets;

wherein the truss span has a tapered profile such that another identical truss span is capable of nesting within the open face area between the first and second structural end brackets wherein:

the at least three parallel chords includes three parallel chords of approximately equal length, including a first chord, a second chord and a third chord, each of the chords having a first end and a second end;

the web includes a first web connecting the first and second chords and a second web connecting the second and third chords; and a first end bracket connecting the first end of the first chord to the first end of the third chord, and a second end bracket connecting the second end of the first chord to the second end of the third chord; and wherein the first end bracket has one end approximately flush with the first end of the first and third chords, and the second bracket has one end approximately flush with the second end of the first and third chords, and wherein the first bracket and the second bracket have generally concave-shaped inside ends.

22. A system, comprising:

a plurality of truss spans, each truss span including:

at least three chords in a generally parallel orientation with respect to each other, wherein adjacent parallel chords form a face such that the at least three chords form at least three faces;

a web connecting two adjacent parallel chords for at least two of the at least three faces; and at least one of the three faces having two adjacent parallel chords connected by two structural end brackets without the two structural end brackets contacting any other of the at least three chords; and the plurality of truss spans having a tapered profile and a stacked configuration where a first truss span nests inside of a second truss span when the first truss span is inserted between the two structural end brackets of the second truss span, and a hub connecting at least two truss spans at a predetermined angle in an assembled configuration, wherein the at least two truss spans radially extend from the hub.

23. A system, comprising:

a plurality of truss spans, each truss span including:

at least three chords in a generally parallel orientation with respect to each other, wherein adjacent parallel chords form a face such that the at least three chords form at least three faces;

a web connecting two adjacent parallel chords for at least two of the at least three faces; and at least one of the three faces having two adjacent parallel chords connected by two structural end brackets without the two structural end brackets contacting any other of the at least three chords; and the plurality of truss spans having a tapered profile and a stacked configuration where a first truss span nests inside of a second truss span when the first truss span is inserted between the two structural end brackets of the second truss span;

a hub connecting at least two truss spans in an assembled configuration, wherein a first one of the at least two truss spans extends in a generally vertical direction from the hub and a second one of the at least two truss spans extends in a generally horizontal direction from the hub.

24. The system of claim 23, wherein the hub is adapted to connect a third truss span in a generally horizontal direction from the hub to form a predetennined angle with the second one of the at least two truss spans in the assembled configuration.

25. A system, comprising:

a plurality of truss spans, each truss span including:

at least three chords in a generally parallel orientation with respect to each other, wherein adjacent parallel chords form a face such that the at least three chords form at least three faces wherein each of the chords includes a cylindrically-shaped tube and wherein:

each tube has a cylindrical wall; and each joint system includes:

a first access opening in the cylindrical wall proximate to a first end of a first tube and a second access opening in the cylindrical wall proximate to a second end of a second tube;

a first end plug with an aperture located in the first end of the first tube and a second end plug with an aperture located in the second end of the second tube; and a fastener extending through the apertures of the first and second end plugs, wherein the first truss span is adapted to be connected to the second truss span by joint systems for connecting chords from one truss span to chords from another truss span;

a web connecting two adjacent parallel chords for at least two of the at least three faces; and at least one of the three faces having two adjacent parallel chords connected by two structural end brackets without the two structural end brackets contacting any other of the at least three chords; and the plurality of truss spans having a tapered profile and a stacked configuration where a first truss span nests inside of a second truss span when the first truss span is inserted between the two structural end brackets of the second truss span.

26. A system, comprising:

a plurality of truss spans, each truss span including:

at least three chords in a generally parallel orientation with respect to each other, wherein adjacent parallel chords form a face such that the at least three chords form at least three faces;

a web connecting two adjacent parallel chords for at least two of the at least three faces; and at least one of the three faces having two adjacent parallel chords connected by two structural end brackets without the two structural end brackets contacting any other of the at least three chords; and the plurality of truss spans having a tapered profile and a stacked configuration where a first truss span nests inside of a second truss span when the first truss span is inserted between the two structural end brackets of the second truss span, further comprising a plurality of connection members, each connection member including a plurality of members, each connection member including a tapered end connecting to a hub such that a number of connection members are able to be attached to a single hub to radially extend from the hub in a single plane.

27. The system of claim 26, wherein the hub includes a cylindrical hub, each connection member including at least one cradle having a first tab and a second tab to contact the cylindrical hub, the first and second tabs extending away from the connection member to enhance stability of the connection member against the hub, the first tab being biased in a upward direction and the second tab being biased in a downward direction such that tabs from adjacent connection members do not interfere with each other at narrow angles.

28. A system, comprising:

a plurality of truss spans, each truss span including:

at least three chords in a generally parallel orientation with respect to each other, wherein adjacent parallel chords form a face such that the at least three chords form at least three faces;

a web connecting two adjacent parallel chords for at least two of the at least three faces; and at least one of the three faces having two adjacent parallel chords connected by two structural end brackets without the two structural end brackets contacting any other of the at least three chords; and the plurality of truss spans having a tapered profile and a stacked configuration where a first truss span nests inside of a second truss span when the first truss span is inserted between the two structural end brackets of the second truss span, a hub, wherein the hub includes a cylindrical wall, and a set of pre-formed holes that fasten connection members to the hub.

29. The system of claim 28, wherein the set of pre-formed holes includes a set of holes equally distributed around a circumference of the hub to fasten four connection members, each connection member being separated from another connection member by approximately 90°.

30. The system of claim 29, wherein the hub further includes a set of pre-formed slots for use to fasten connection members to the hub, the slots being positioned between the holes.

31. The system of claim 30, wherein the set of pre-formed holes and the set of pre-formed slots are positioned and sized to allow a connection member to be connected to the hub within a plane with another connection member and at an adjustable angle.

* * * * *